US007150099B2

(12) United States Patent
Whittenberger et al.

(10) Patent No.: US 7,150,099 B2
(45) Date of Patent: Dec. 19, 2006

(54) HEAT EXCHANGER FOR HIGH-TEMPERATURE APPLICATIONS

(75) Inventors: William A. Whittenberger, Leavittsburg, OH (US); Richard C. Cornelison, deceased, late of Boulder, CO (US); by Kathleen Ruff, legal representative, Smithers (CA)

(73) Assignee: Catacel Corp., Leavittsburg, OH (US)

( * ) Notice: Subject to any disclaimer, the term of this patent is extended or adjusted under 35 U.S.C. 154(b) by 394 days.

(21) Appl. No.: 10/812,506

(22) Filed: Mar. 30, 2004

(65) Prior Publication Data

US 2005/0217836 A1 Oct. 6, 2005

(51) Int. Cl.
*B21D 53/02* (2006.01)

(52) U.S. Cl. ..... 29/890.03; 165/165; 165/DIG. 399

(58) Field of Classification Search ..... 165/164–166, 165/DIG. 399; 29/890.03
See application file for complete search history.

(56) References Cited

U.S. PATENT DOCUMENTS

| | | | | | |
|---|---|---|---|---|---|
| 2,019,351 | A * | 10/1935 | Lathrop | 165/165 |
| 3,364,548 | A * | 1/1968 | Marco | 165/166 |
| 3,640,340 | A * | 2/1972 | Leonard et al. | 165/166 |
| 3,829,945 | A * | 8/1974 | Kanzler et al. | 29/890.03 |
| 4,041,591 | A * | 8/1977 | Noll et al. | 165/166 |
| 4,043,388 | A * | 8/1977 | Zebuhr | 165/166 |
| 4,109,710 | A * | 8/1978 | Forster et al. | 165/165 |
| 4,202,408 | A * | 5/1980 | Temple | 165/164 |
| 5,105,617 | A * | 4/1992 | Malohn | 165/165 |
| 5,458,187 | A * | 10/1995 | Davis | 165/165 |
| 5,470,531 | A * | 11/1995 | Sjogren et al. | 165/165 |
| 6,098,706 | A * | 8/2000 | Urch | 165/166 |
| 6,244,333 | B1 | 6/2001 | Bergh et al. | |
| 6,920,920 | B1 * | 7/2005 | Whittenberger | 165/165 |
| 7,036,560 | B1 * | 5/2006 | Rylewski | 165/165 |

* cited by examiner

*Primary Examiner*—Leonard R. Leo
(74) *Attorney, Agent, or Firm*—William H. Eilberg

(57) ABSTRACT

A heat exchanger is formed of a strip of corrugated material that is folded back and forth upon itself to define a stack. Cut pieces of corrugated material are inserted within the folds of the strip, such that the corrugations of the cut pieces are generally perpendicular to the corrugations of the folded strip. A set of duct attachments holds the assembly together, and provides paths for fluid flowing into and out of the exchanger. The ends of the stack, and those parts of the sides that are not spanned by the duct attachments, are sealed with a high-temperature sealant. The sealant is preferably a moldable material that is applied and allowed to harden, and which has a coefficient of thermal expansion that approximates that of the stack. The heat exchanger is easy and inexpensive to manufacture, but is suitable for use in high-temperature applications.

30 Claims, 7 Drawing Sheets

HEAT EXCHANGER FOR HIGH-TEMPERATURE APPLICATIONS

BACKGROUND OF THE INVENTION

The present invention relates to the field of heat exchange, and provides a heat exchanger that is useful in managing the heat generated by solid oxide fuel cell systems, and in other applications.

A solid oxide fuel cell (SOFC) generates waste products having a high temperature, which can be of the order of about 900° C. To make the fuel cell more efficient, the heat from the fuel cell outlet must be redirected and combined with the products entering the fuel cell inlet. Redirecting the heat requires a heat exchanger that can handle the high temperatures produced in the fuel cell. For the system to be economical, the heat exchanger must be very simple in construction, and of low cost. It also must be compact.

The present invention provides a heat exchanger that satisfies the above criteria. The heat exchanger of the present invention is easy to manufacture, and provides the desired high-temperature performance. The heat exchanger of the present invention is especially intended for gas-to-gas heat exchange for SOFC systems, but may be used in other applications.

SUMMARY OF THE INVENTION

The heat exchanger of the present invention is made of a corrugated strip, preferably, but not necessarily, formed of a metal foil, the strip being folded back and forth upon itself to define a stack having a plurality of folds. A plurality of cut pieces of corrugated material are inserted within the folds. The corrugations of the cut pieces are generally perpendicular, or at least non-parallel, to the corrugations of the folded strip. A plurality of duct attachments hold the stack together, and also provide fluid connection ports for directing fluid into or out of the stack. The ends of the stack, and those portions of the sides of the stack that are not spanned by the duct attachments, are covered by a high-temperature sealant.

In one preferred embodiment, there is a pair of duct attachments on one side of the stack and another pair of duct attachments on the other side. The first pair is used to convey a first stream into and out of the heat exchanger, and the second pair is used to convey a second stream into and out of the device. In other embodiments, there may be additional duct attachments on each side.

The high-temperature sealant is a moldable material that is applied to the ends of the stack, and to parts of the sides of the stack, and which is allowed to harden. The moldable material may be applied by thermoplastic injection molding, preferably simultaneously at the two ends of the stack. Alternatively, the moldable material could be a liquid metal that is applied by pressure die casting, such as with alloys of aluminum or zinc. The material can also be simply applied as a paste or slurry, and allowed to harden. The ends of the folded material, and/or the ends of the cut pieces, may include small dimples or holes which create surface features that promote adhesion of the moldable material to the stack.

The corrugations of the cut pieces essentially define manifolds which distribute incoming gas flow to various longitudinal channels defined by corrugations of the folded strip. Gas is therefore made to flow into the stack, at or near one end, and then makes a right-angle turn to flow along the length of the stack (i.e. along the width of the original strip).

Then, the gas makes another right-angle turn, near the other end of the stack, and flows out of the stack, through channels defined by the cut pieces.

If there are duct attachments at locations other than the ends of the stack, the pattern of fluid flow may be altered. For example, gas may be made to flow into or out of the heat exchanger through a duct attachment near the center of the stack, in which case some of the other duct attachments may change from inlet ducts to outlet ducts, or vice versa.

For high-temperature operation, it is desirable that the sealant have a coefficient of thermal expansion which is approximately equal to that of the material forming the stack. A sealant may be mixed with a quantity of metal particles, or metal powder, so as to adjust the coefficient as needed.

The invention also includes the method of making a heat exchanger having the above-described features. The exchanger so made is compact and relatively inexpensive to manufacture, but it is still capable of operating at high temperatures, of the order of 900° C. The invention also includes the method of using a moldable material to form end pieces, and other sealing pieces, for a monolith formed of a folded stack.

The present invention therefore has the primary object of providing a heat exchanger.

The invention has the further object of providing a heat exchanger which is capable of operating at temperatures as high as about 900° C.

The invention has the further object of providing a heat exchanger that is durable.

The invention has the further object of providing a heat exchanger which is suitable for use with solid oxide fuel cell (SOFC) systems.

The invention has the further object of providing a high-temperature heat exchanger which can be manufactured easily and inexpensively.

The invention has the further object of providing a method of making a high-temperature heat exchanger.

The invention has the further object of providing a method of sealing portions of a monolith, such that the monolith can function as a heat exchanger.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
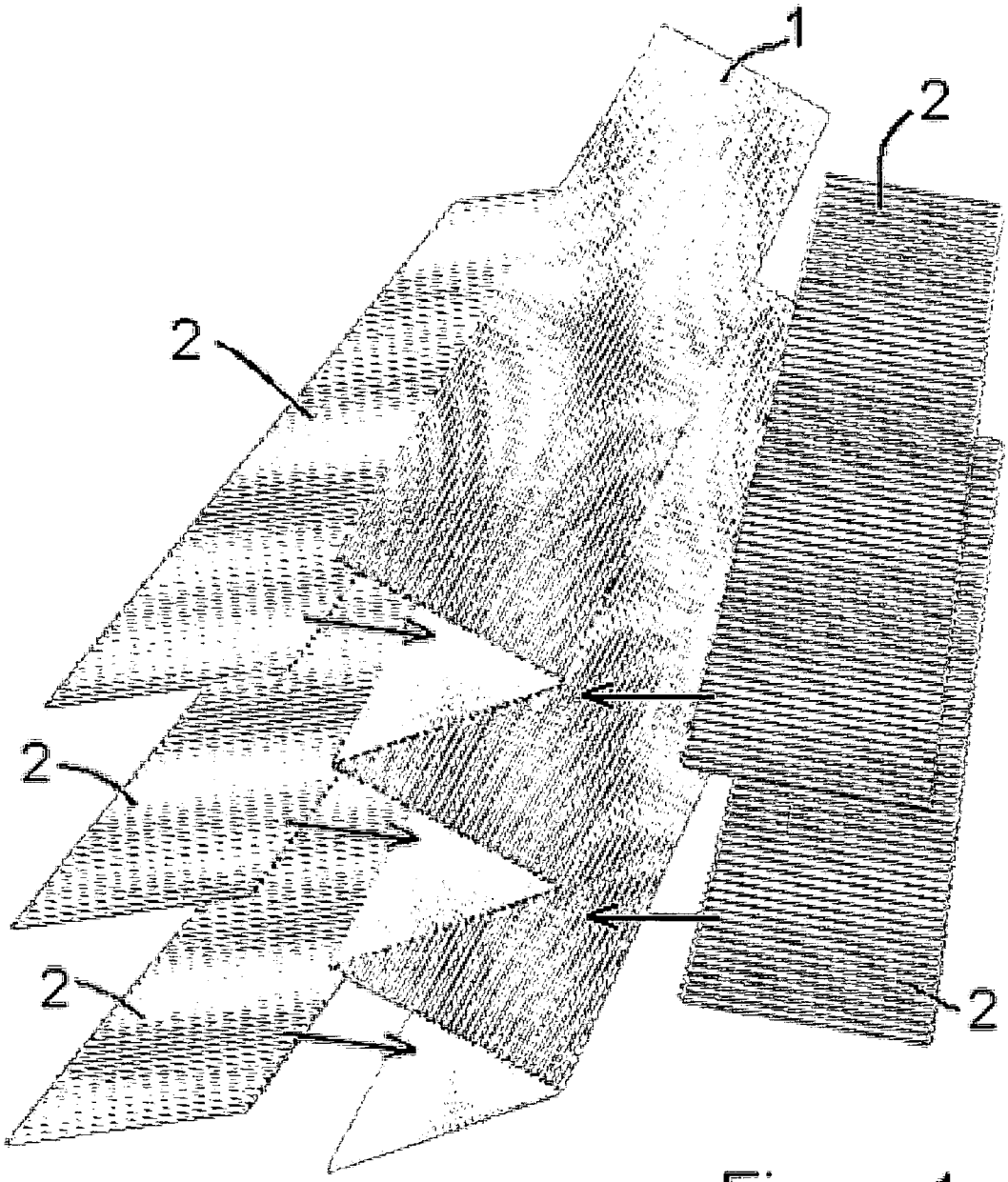
FIG. 1 provides an exploded perspective view of a folded strip and a plurality of cut pieces, showing an initial step in the construction of the heat exchanger of the present invention.

The heat exchanger of the present invention comprises a core formed of a folded stack of corrugated material, with cut pieces of corrugated material inserted within the folds. The basic structure is shown in FIG. 1. Corrugated material 1, which may be a strip of metal foil, is folded back and forth upon itself, as shown in the figure. The width (i.e. the shorter dimension) of the strip becomes the length of the folded structure. This folded material forms the primary heat exchange surface and constitutes the primary barrier between two distinct fluid streams, each of which flows into and out of the heat exchanger. Cut pieces 2 are inserted within the folds, as indicated by the arrows.

The corrugations of material 1 are preferably aligned generally parallel to the fold lines of the material. That is, material 1 has generally straight corrugations. One might use other corrugation patterns, such as herringbone corrugations or skew or other corrugation patterns, which may improve the heat transfer, but such arrangements are likely to increase the pressure drop through the exchanger.

The stack described above is preferably made from 2-mil Fecralloy foil, which is inexpensive and which tolerates the intended service temperatures well. But the invention should not be deemed limited to any particular material, and is not limited to the use of metal.

The corrugations of cut pieces 2 are generally transverse to the longitudinal axis of each such piece. When the cut pieces 2 are inserted within the folds, their corrugations are generally perpendicular to the fold lines of material 1. Like the corrugations of material 1, the corrugations of the cut pieces are also generally straight. In the preferred embodiment, the corrugations of material 1 and cut pieces 2 are generally perpendicular to each other, as is apparent in FIG. 1.

The cut pieces 2, in effect, comprise manifolds, allowing fluid flow from inlet ducts to become distributed along the width of the folded stack.

The cut pieces are conveniently made from the same material as the folded material 1. However, the invention is not limited by the latter feature, and the cut pieces could, if desired, be formed of a material that is different from that forming the main folded structure.

Figure 2:
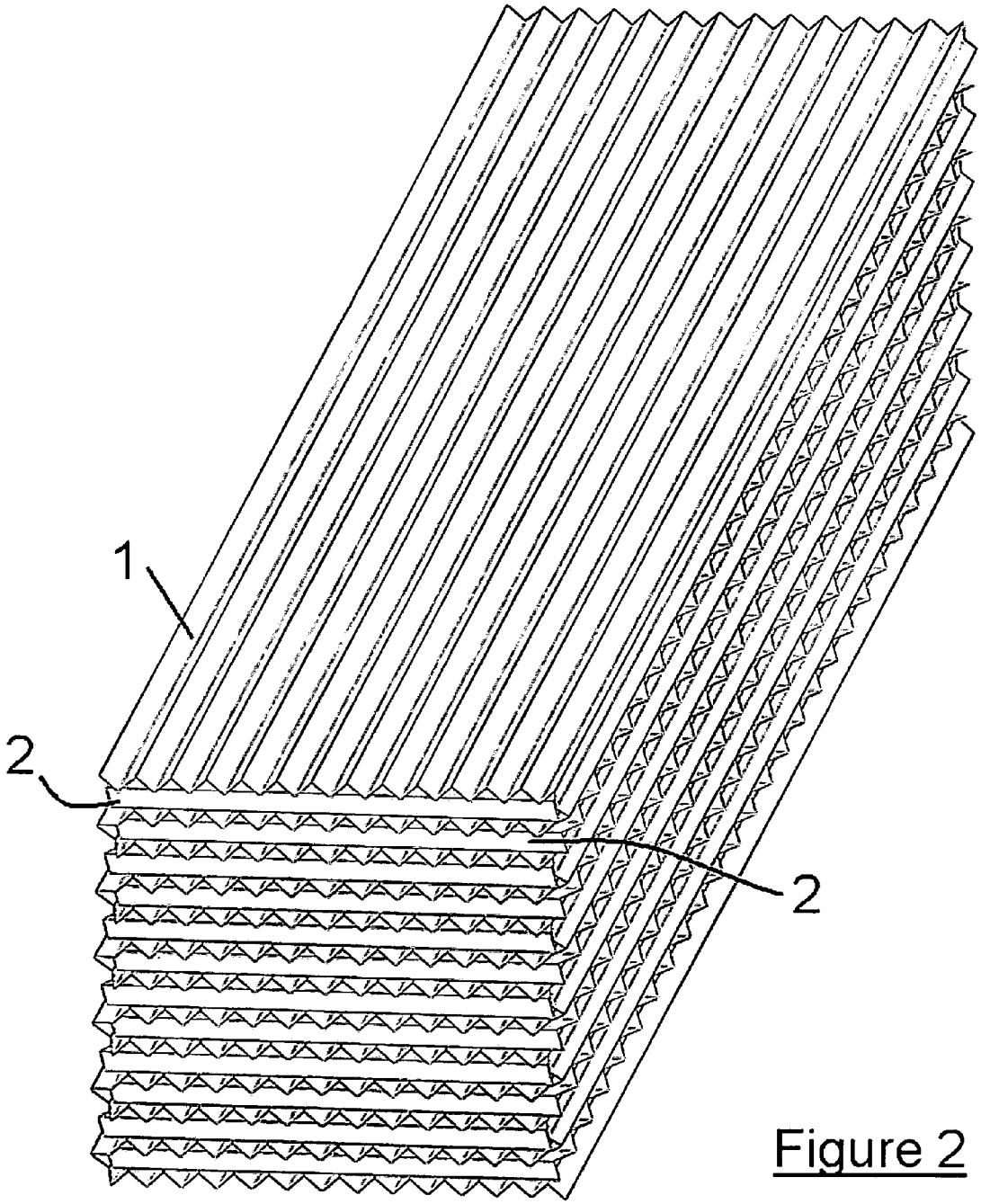
FIG. 2 provides a perspective view of a folded stack formed as illustrated in FIG. 1, the stack forming the core of the heat exchanger of the present invention.

FIG. 2 provides a perspective view of a completed stack, also known as a monolith, formed as indicated in FIG. 1. As in FIG. 1, FIG. 2 shows folded corrugated material 1, and cut pieces 2 inserted within the folds. The folded material 1 defines two distinct regions, namely the region on the left-hand side and the region on the right-hand side of the figure. These regions correspond to fluid paths for two distinct fluid streams. The purpose of the heat exchanger is to transfer heat from one such fluid stream to the other, without allowing commingling of the two streams.

Figure 3:
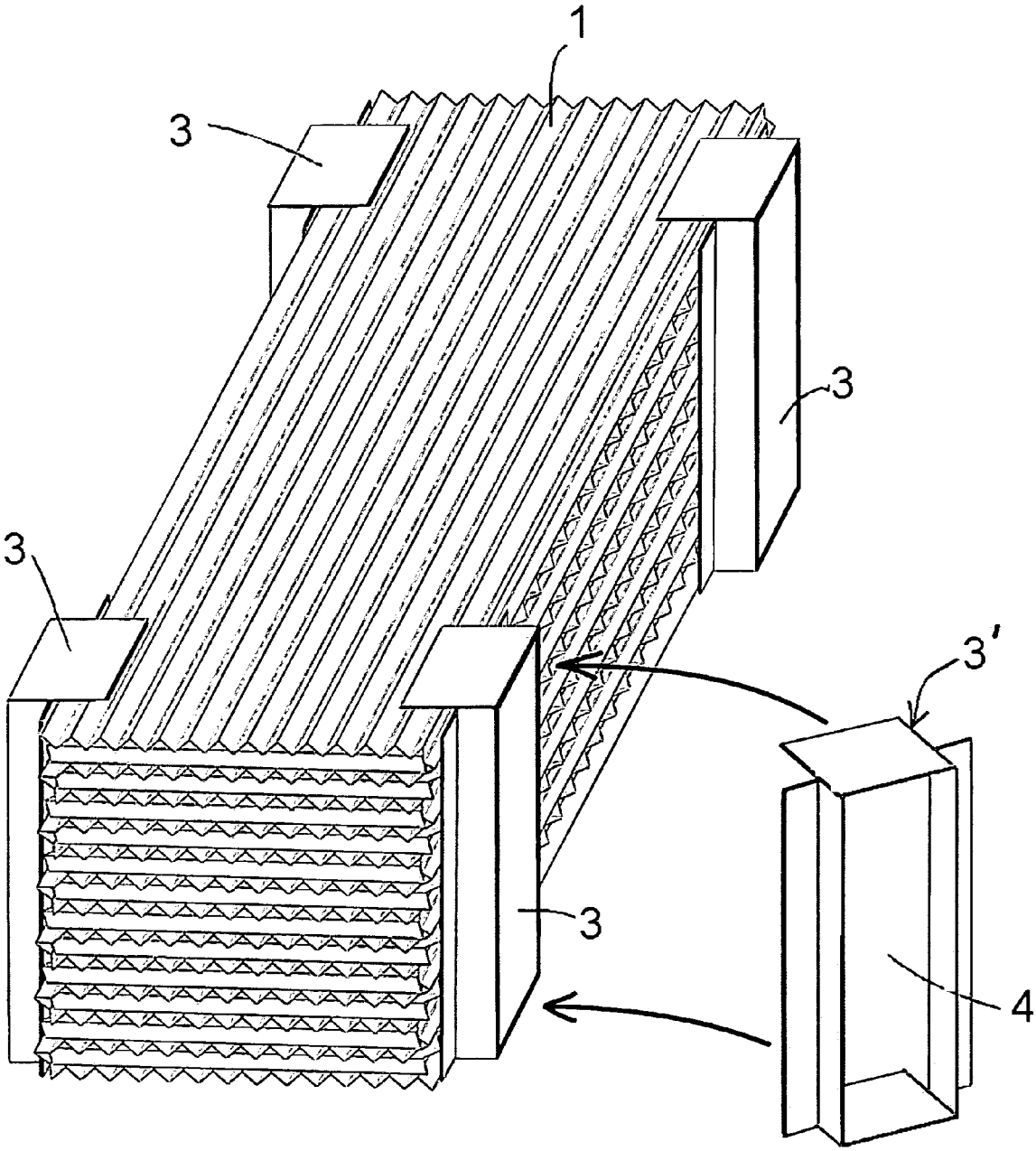
FIG. 3 provides a perspective view of the folded stack, and showing the duct attachments which both hold the stack together and provide fluid communication between the interior and exterior of the stack.

FIG. 3 shows the folded stack with a plurality of duct attachments 3. The figure shows one of the duct attachments, labeled 3', before it has been affixed to the stack, to illustrate the function of the component. The duct attachments serve two purposes. First, they act as structural elements, namely clips that fasten the layers of the stack together, and hold them in place. Secondly, by virtue of the opening 4 defined by each duct attachment, they provide a fluid connection port between the interior of the stack and the exterior. It is important to note that the duct attachments on the left-hand side of FIG. 3, and the duct attachments on the right-hand side, provide fluid connections, respectively, to the two distinct regions defined by the folded material 1.

Figure 4:
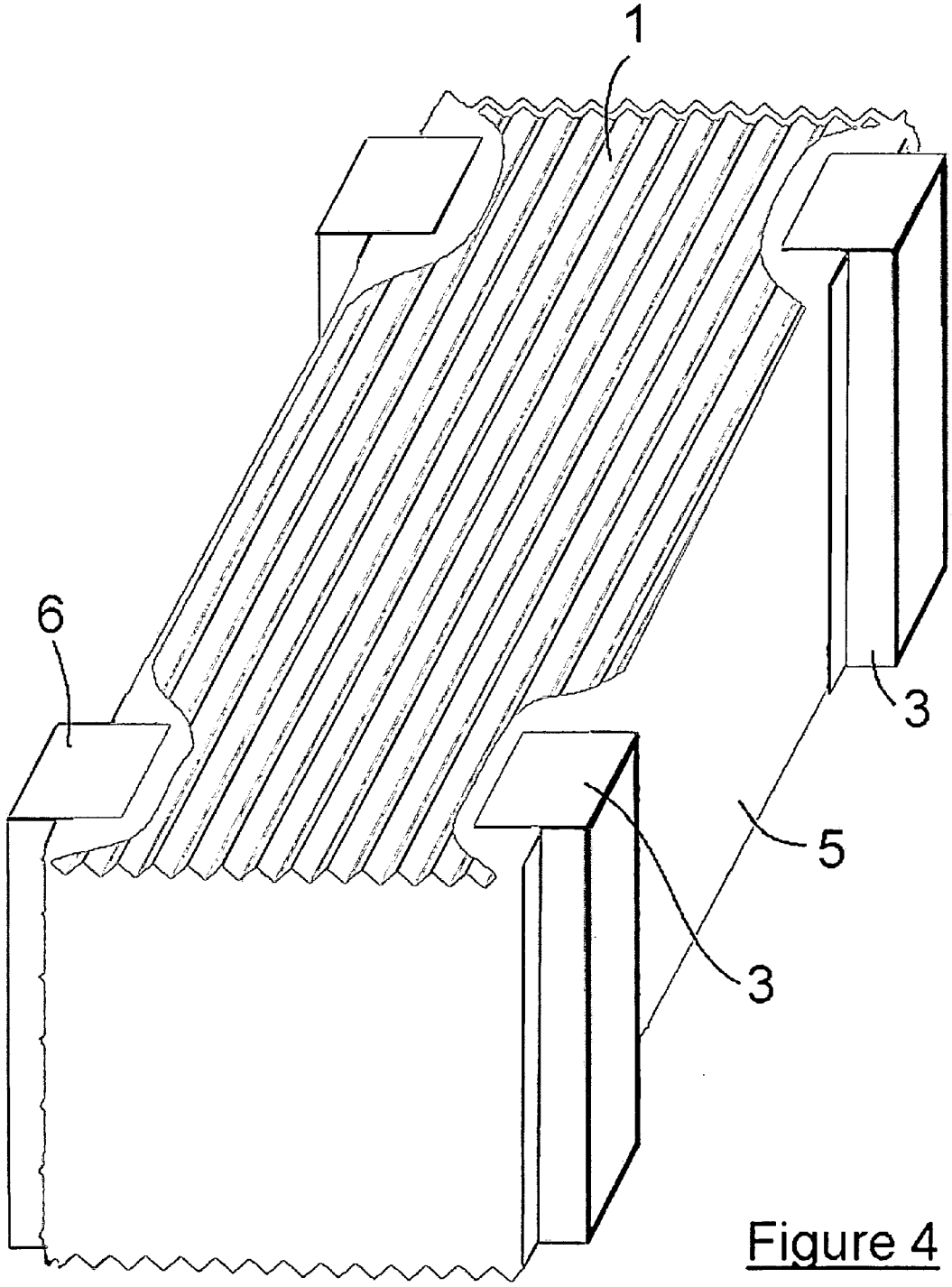
FIG. 4 provides a perspective view of the folded stack with the duct attachments, while also showing the sealant applied to portions of the exterior of the stack, to form the heat exchanger of the present invention.

FIG. 4 illustrates a further stage in the construction of the heat exchanger of the present invention. A high-temperature sealant 5 is applied to the two ends of the folded stack, as well as to those parts of the sides of the stack where there are no duct openings. The top and bottom of the stack do not need sealant, because the top and bottom are defined by folds of solid corrugated material 1, and are therefore already sealed. However, in practice, it is necessary to provide some sealant around the clip portions 6 of the duct attachments, so there will still be a small amount of sealant on the top and bottom surfaces (only the top being visible in FIG. 4). Note also that the sealant is present on both the left-hand and right-hand sides, in locations not spanned by the duct attachments, but that the sealant on the left-hand side is not visible in the figures.

Before it is used, the structure of FIG. 4 is preferably wrapped with blanket insulation (not shown) and placed into an outer can (not shown). Ducts (not shown) can then be connected to the duct attachments.

In the simplest case, there are four duct attachments for the stack, comprising an inlet duct and an outlet duct for each of two streams. In a more general case, there may be additional duct attachments that create useful flow patterns. For example, one could use three ducts per side, putting the hot inlet gas in the center duct. The entering gas stream would then split inside the core and flow towards both of the two ends, exiting at the two (cool) ducts on either end. On the opposite side of the exchanger, the inlet (cool) gas would enter through the two end ducts, and would exit as heated gas through the single center duct. This arrangement provides a symmetrical temperature distribution in the core, namely hot in the center and cooler at either end, and allows the sealant on either end to operate at a lower temperature, thereby extending the useful life of the sealant.

Figure 5:
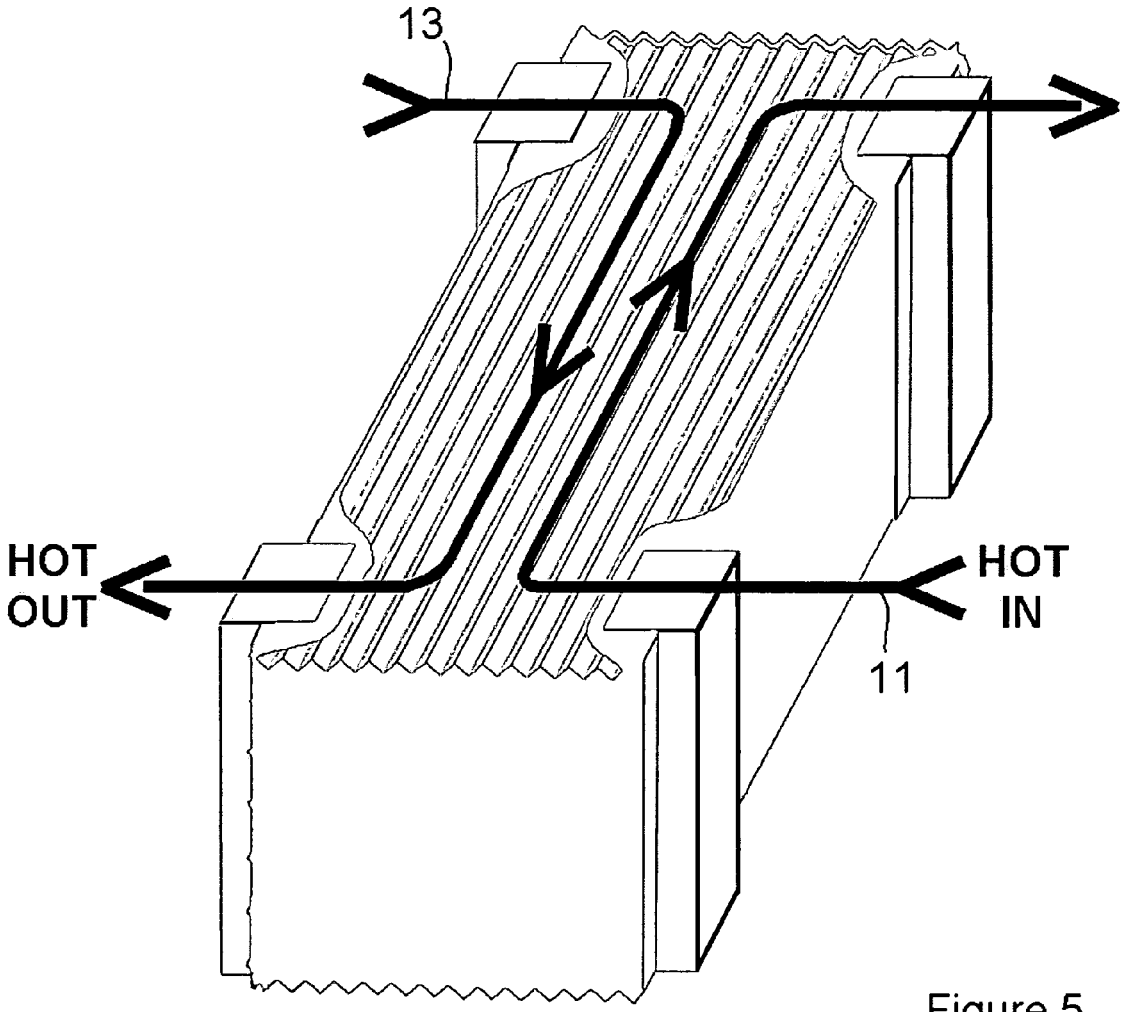
FIG. 5 provides a perspective view of the heat exchanger of the present invention, including arrows illustrating some of the flow paths for fluid.

FIG. 5 provides a perspective view of a heat exchanger, made according to the simplest case of the present invention, as described above, and showing the flow of gas. Arrow 11 represents a typical path of hot gas that is directed into the heat exchanger. The hot gas enters through one of the duct attachments, and flows first through a channel defined by the corrugations of one the cut pieces 2 (not visible in FIG. 5), the channel being generally transverse to the long dimension of the exchanger. The fluid then makes a right-angle turn, and flows lengthwise along the exchanger, through another channel defined by corrugations in the folded material 1. The fluid then makes another right-angle turn, and flows out of the exchanger through another channel defined by corrugations of one of the cut pieces, and then exits through the other duct attachment.

Meanwhile, the other gas stream, which is intended to be heated, is directed through the exchanger as shown by arrow 13, making two right-angle turns, similar to those described for the other stream. Due to the structure of folded material 1 (only the top fold of which is visible in FIG. 5), the streams represented by arrows 11 and 13 do not mix, but affect each other only by thermal conduction through the material 1. Thus, heat from the gas stream entering at the right-hand side of FIG. 5 is transferred to the gas stream entering at the left-hand side.

It should be understood that, for simplicity of illustration, only one set of arrows is shown for each stream, in FIG. 5. That is, the arrows show the gas flow paths only near the top surface of the heat exchanger, and only for a particular longitudinal path through the exchanger. But the gas can enter at any vertical position along the duct attachment, and can then flow through any of a plurality of channels defined by corrugations of piece 1. FIG. 5 therefore shows only one of many possible paths for the gas flow.

Figure 6:
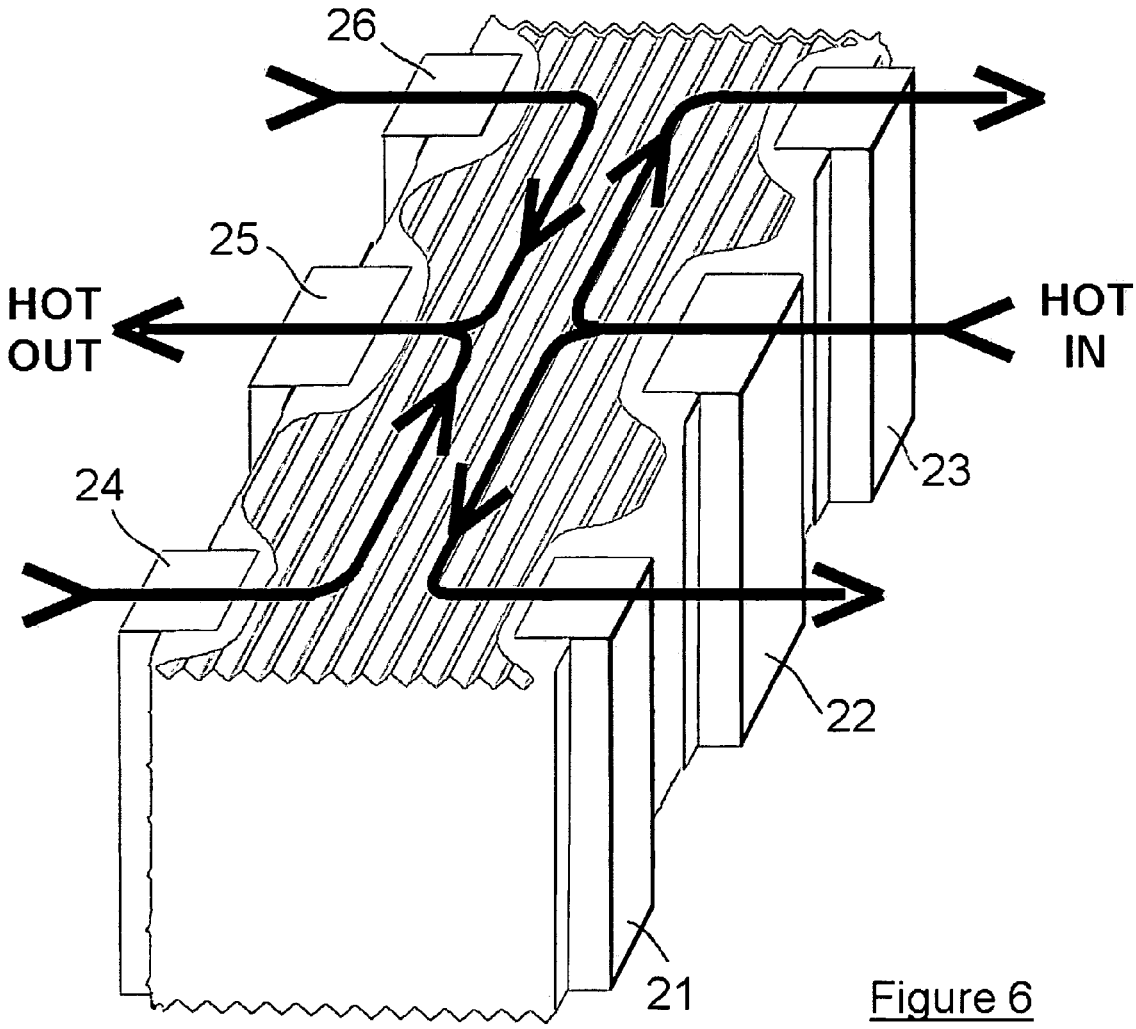
FIG. 6 provides a perspective view of a heat exchanger of the present invention, wherein there are six duct attachments, and showing typical flow paths for fluid.

FIG. 6 shows the case, described above, in which there are three ducts on each side. In the arrangement shown, the hot gas introduced on the right-hand side is connected to the middle duct attachment 22, and the hot stream is divided into two. The hot stream gives up some of its heat, and becomes cooled, the cooled stream being withdrawn at both of the outer ducts 21 and 23. Similarly, gas to be heated is directed into duct attachments 24 and 26, and becomes heated while flowing through the exchanger. The heated gas is withdrawn through duct attachment 25. As before, for clarity of illustration, the arrows show only one possible path for gas entering near the top of the stack.

The high-temperature sealant can be any of various materials. Examples of materials usable as the sealant in the present invention include products available from Cotronics Corporation, of Brooklyn, N.Y., particularly those products sold under the product labels 907F, 7020, 954, 952, or 7032. Alternatively, one could use products from Unifrax Corporation, of Niagara Falls, N.Y., sold under the trademarks UNIFRAX LDS, FIBERMAX CAULK, or TOPCOAT 3000. Other alternatives include Hercules High-Heat Furnace Cement #35-515, available from Hercules Inc., and Rutland #77/78 Stove Gasket Cement.

In addition to the above-listed commercially available materials, it is possible to use, as the sealant, a catalyst washcoat mixed with a metal powder, such as Nicrobraz 150 metal brazing powder. In one example, a washcoat was prepared which included, on a solids basis, 84% Sasol SBA-200 (calcined) alumina, 10% Sasol 18N4-80 Dispal (bohemite) alumina, and 6% nitric acid, to which there was added DI water. The mixture, including the alumina, the acid, and the water, was milled until the particle size was about 5 microns, and the metal powder was then added to the milled product. The Nicrobraz 150 is available from Wall Colmonoy Corp.

It is desirable that the sealant have a coefficient of thermal expansion that is approximately the same as that of the corrugated material. By "approximately the same" it is meant that the coefficients of thermal expansion of the two materials be within about 25% of each other. In general, the more closely matched the coefficients of expansion, the better. With operating temperatures of the order of 900° C., the matching of the coefficients of expansion is clearly important in promoting the long-term durability of the heat exchanger. The coefficient of thermal expansion of the sealant can be adjusted by mixing the sealant with small particles of metal, or with metal powders. Since the sealant materials are primarily ceramic, such materials have a much lower coefficient of expansion than that of the metal particles. Mixing the metal particles or powder with the ceramic can therefore yield a product having a coefficient of expansion that approximates the coefficient for the corrugated stock.

A convenient size for the core element, i.e. the folded stack of material 1 with cut pieces 2, is about 3 inches×3 inches×(6 to 12 inches), where the last dimension is the length of the stack. A preferred dimension for the length of the stack is about 9 inches. Experiments have shown that a device of this size will transfer about 3 kW of heat when operated in counterflow mode when the inlet temperature for one stream is about 900° C., and the inlet temperature for the other stream is ambient temperature. When additional heat transfer capability is needed, multiple core elements may be stacked into a package, with common ducting connecting to the duct attachment points.

The invention should not be deemed limited by the specific dimensions given in the above example; many other embodiments can also be used, within the scope of the invention.

The heat exchanger of the present invention has the advantage that it uses very simple corrugation patterns. As described above, the invention uses a simple, crossed pattern, with no special treatments on the ends or edges. These features substantially reduce the cost of manufacture.

The present invention has the further advantage that it can use inexpensive high-temperature sealants, instead of using expensive manufacturing processes such as welding, brazing, gasketing, or the like.

As explained above, due to the crossed corrugation patterns, the gas at any point in the heat exchanger can flow in two directions. That is, the gas can flow parallel to the fold lines, along the long axis of the exchanger, or it can flow along the channels defined by the corrugations in the cut pieces, i.e. perpendicular or transverse to the long axis of the exchanger. The actual balance between longitudinal and transverse flow is determined by local pressure balance conditions. Immediately inside the duct connection, most of the flow is transverse, as the gas has momentum in that direction, and resists turning to go in the longitudinal direction. In the center of the exchanger, most of the flow is along the longitudinal axis, as there is no real driving force to make the gas flow in the transverse direction. Understanding the pressure balance at each point allows one to determine the exact exchanger geometry that will provide approximate uniform flow through the exchanger at a given operating condition.

In the heat exchanger of the present invention, the ends of the stack must be sealed to insure that gas flows along the desired paths. Thus, in the example represented by the stack shown in FIG. 2, the two ends, only one of which is visible and is shown at the lower left-hand portion of the figure, must be sealed. It is possible to provide a "header" at each end which effects the desired sealing. If the header were metallic, it could be attached to the stack by welding or brazing. But the latter method is costly and cumbersome. In the present invention, the header is formed by the sealant material, which is easily shaped or molded, and which hardens so as to form a barrier to gas flow. As described above, the present invention also uses the same sealant to seal other portions of the stack, and not just the ends.

The use of the sealant to form headers is only one way of accomplishing the same objective. It is also possible to provide headers by casting them in place at each end, either by thermoplastic injection molding or pressure die casting with alloys of aluminum or zinc. The latter can be conveniently accomplished by inserting the stack comprising the heat exchanger into a mold which encompasses both ends of the stack. The thermoplastic injection process, or its equivalent, could then be made to take place at each end simultaneously. At the same time, air pressure introduced at the center of the stack serves to overcome the effects of gravity and assures that each end of the honeycomb core is filled equally (typically to a depth of about 0.375 inches) with thermoplastic or liquid metal, as the case may be.

Figure 7:
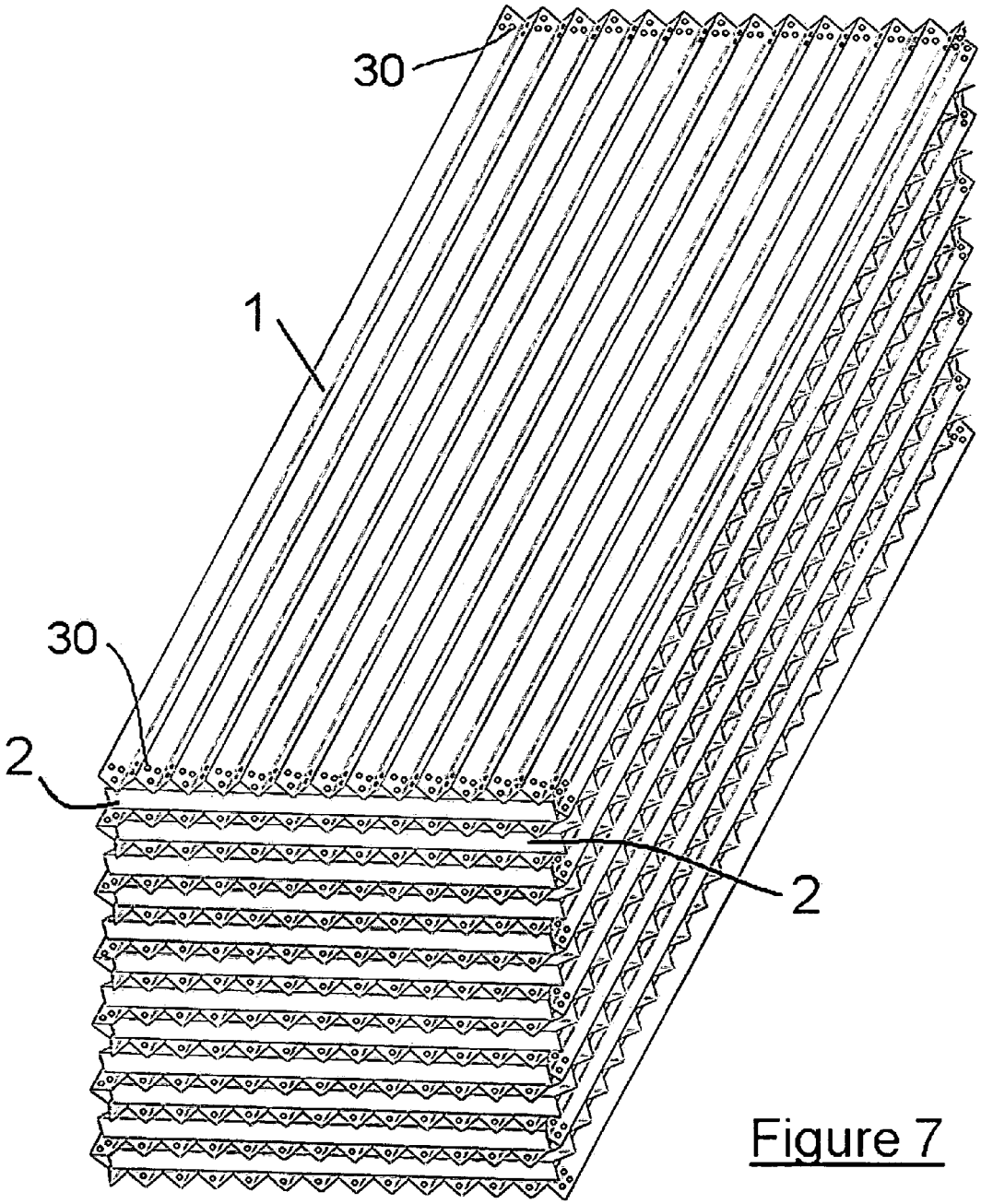
FIG. 7 provides a perspective view of another embodiment of the heat exchanger of the present invention, wherein there are holes or dimples at the ends of the monolith, to facilitate the adhesion of the sealant to the monolith.

The metal stack may have small perforations or dimples or lances which provide an opportunity for the liquid thermoplastic or metal to flow around and through these irregularities so as to increase the shear strength of the completed part. In effect, the dimples or holes form surface irregularities at which the sealant can form a better grip on the foil. FIG. 7 shows this arrangement. Dimples or holes 30 are punched in the ends of the folded foil 1. Similar dimples may be punched at the edges of the cut pieces 2, if desired.

Another manufacturing method involves squirting a sealant material into an end cap, and then jamming the end cap over the open ends of the folded stack.

Thus, one important aspect of the invention is the sealing of the ends of a folded stack, forming the heat exchanger, with a moldable material that becomes hard, and which therefore becomes a gas-impervious barrier. Any of the above-described methods could be used, as long as the result is the desired gas-impervious barrier.

Some applications for the heat exchanger of the present invention may involve corrosive or abrasive flow. In such applications, it may be desirable to form the exchanger of non-metallic materials that resist such corrosion or abrasion, such as Teflon. (Teflon is a trademark of E. I. du Pont de Nemours & Co., of Wilmington, Del.) Teflon has been used in heat exchangers, but only in the form of tubes, and not as folded corrugated sheets. Thus, instead of a corrugated metal strip, one could make the heat exchanger of the present invention from a corrugated Teflon sheet, or from some other non-metallic material.

The invention can be modified in many ways. The dimensions of the heat exchanger can be changed. Various materials can be used for the folded stack and the cut pieces. The folded stack and the cut pieces can be made of the same or different materials. The exact configuration of duct attachments can be modified to suit particular needs. The invention also is not limited to a particular sealant material, or to a particular method of applying the sealant. These and other modifications, which will be apparent to the reader skilled in the art, should be considered within the spirit and scope of the following claims.

What is claimed is:

1. A heat exchanger comprising:

a) a corrugated strip, the strip being folded back and forth upon itself to define a stack having a plurality of folds, b) a plurality of pieces of corrugated material, the pieces being inserted within said plurality of folds, wherein the pieces have corrugations which are non-parallel to corrugations of the strip, c) a plurality of duct attachments, each duct attachment comprising means for holding the stack together, and for providing fluid access to an interior region of the stack, and d) a high-temperature sealant disposed on an outside surface of the stack, wherein the sealant is disposed in locations not spanned by said duct attachments, wherein the sealant has a coefficient of thermal expansion which approximates a coefficient of thermal expansion of materials forming the stack, and wherein the sealant includes metal particles.

2. The heat exchanger of claim 1, wherein the corrugated strip has straight corrugations which are generally parallel to an edge of the strip, and wherein the corrugations of said pieces of corrugated material are generally perpendicular to said straight corrugations of said corrugated strip.

3. The heat exchanger of claim 1, wherein the stack has first and second sides, and wherein there is a pair of duct attachments on the first side and a pair of duct attachments on the second side.

4. The heat exchanger of claim 1, wherein the stack has first and second sides, and wherein there is a pair of duct attachments located at two ends of the first side and a pair of duct attachments located at two ends of the second side, and wherein each side also includes a duct attachment located, respectively, between said two ends.

5. The heat exchanger of claim 1, wherein the sealant comprises a moldable material that has been allowed to harden.

6. The heat exchanger of claim 1, wherein the cut pieces are formed from a same material as the corrugated strip.

7. The heat exchanger of claim 1, wherein the stack includes a plurality of dimples or holes for promoting adhesion of the sealant.

8. A heat exchanger comprising:

a) a corrugated strip, the strip being folded back and forth upon itself to define a stack having a plurality of folds, the stack having two ends, b) a plurality of pieces of corrugated material, the pieces being inserted within said plurality of folds, wherein the pieces have corrugations which are non-parallel to corrugations of the strip, c) a plurality of duct attachments affixed to the stack, and d) a high-temperature sealant disposed on an outside surface of the stack, wherein the sealant is disposed at least at the ends of the stack, wherein the sealant has a coefficient of thermal expansion which approximates a coefficient of thermal expansion of materials forming the stack, and wherein the sealant includes metal particles.

9. The heat exchanger of claim 8, wherein the corrugations of the strip and the corrugations of the plurality of pieces are generally mutually perpendicular.

10. The heat exchanger of claim 8, wherein the stack has first and second sides, and wherein there are at least two duct attachments on the first side and at least two duct attachments on the second side.

11. The heat exchanger of claim 8, wherein the sealant comprises a moldable material that has been allowed to harden.

12. The heat exchanger of claim 8, wherein the cut pieces are formed from a same material as the corrugated strip.

13. The heat exchanger of claim 8, wherein the stack includes a plurality of dimples or holes for promoting adhesion of the sealant.

14. A heat exchanger comprising:

a) a corrugated strip, the strip being folded back and forth upon itself to define a stack having a plurality of folds, the stack having first and second sides and two ends, b) a plurality of pieces of corrugated material, the pieces being inserted within said plurality of folds, wherein the pieces have corrugations which are generally perpendicular to corrugations of the strip, c) a plurality of duct attachments, each duct attachment comprising means for holding the stack together, and for providing fluid access to an interior region of the stack, wherein there are at least two duct attachments on the first side of the stack, and wherein there are at least two duct attachments on the second side of the stack, and d) a high-temperature sealant disposed on an outside surface of the stack, wherein the sealant is disposed in locations not spanned by said duct attachments, wherein the sealant has a coefficient of thermal expansion which approximates a coefficient of thermal expansion of materials forming the stack, and wherein the sealant includes metal particles.

15. The heat exchanger of claim 14, wherein each side includes a pair of duct attachments located near the two ends of the stack, and wherein each side also includes a duct attachment located near a middle of the stack.

16. The heat exchanger of claim 14, wherein the sealant comprises a moldable material that has been allowed to harden.

17. The heat exchanger of claim 14, wherein both the cut pieces and the strip are formed from a same material.

18. The heat exchanger of claim 14, wherein the stack includes a plurality of dimples or holes for promoting adhesion of the sealant.

19. A heat exchanger comprising a strip of corrugated material which has been folded back and forth upon itself to define a monolith, the monolith having a pair of ends, the ends being sealed by a moldable material that has been allowed to harden, wherein the sealant has a coefficient of thermal expansion which approximates a coefficient of thermal expansion of materials forming the monolith, and wherein the sealant includes metal particles.

20. The heat exchanger of claim 19, wherein the monolith defines a plurality of folds, the heat exchanger further comprising a plurality of cut pieces of corrugated metal, inserted within the folds, the cut pieces having corrugations which are generally perpendicular to corrugations of the strip.

21. The heat exchanger of claim 19, wherein the ends of the monolith include a plurality of dimples or holes for promoting adhesion of the moldable material.

22. A heat exchanger comprising:

a) a strip of material that has been folded back and forth upon itself to define a stack, the material having corrugations which define channels for fluid flow, the stack having first and second sides for receiving first and second fluid streams, b) means for directing fluid flow within the stack such that said first and second fluid streams flow within the stack without commingling and in sufficient proximity to allow heat transfer between the streams, and c) means for sealing the stack such that fluid cannot flow to or from a region outside the stack except through said directing means, wherein the sealing means comprises a moldable material that has been allowed to harden so as to seal the stack, wherein the moldable material has a coefficient of thermal expansion which approximates a coefficient of thermal expansion of the stack, and wherein the sealant includes metal particles.

23. A method of making a heat exchanger, comprising:

a) folding a corrugated strip back and forth upon itself to define a plurality of folds, b) inserting cut pieces of corrugated material within the folds of the corrugated strip, the folded strip and the cut pieces together defining a stack, c) affixing a plurality of duct attachments to the stack, and d) applying a sealant to portions of the stack which are not covered by the duct attachments, further comprising selecting a coefficient of thermal expansion of the sealant so as to approximate a coefficient of thermal expansion of the stack, wherein the selecting step includes mixing the sealant with metal particles so as to produce a mixture having a desired coefficient of thermal expansion.

24. The method of claim 23, wherein the stack includes first and second sides and a pair of ends, and wherein step (c) comprises affixing at least two duct attachments to the first side and at least two duct attachments to the second side.

25. The method of claim 24, wherein step (d) includes applying the sealant to the ends of the stack, and applying the sealant to portions of the first and second sides which are not covered by the duct attachments.

26. The method of claim 23, wherein step (d) comprises attaching a moldable material to the stack, and allowing the moldable material to harden so as to seal at least a portion of the stack.

27. The method of claim 23, further comprising the step of forming dimples or holes in portions of the stack.

28. A method of making a heat exchanger, comprising folding a corrugated strip back and forth upon itself to define a monolith having a pair of ends, applying a moldable material to the ends of the monolith, and allowing the moldable material to harden so as to form a sealant for the monolith, further comprising selecting the moldable material to have a coefficient of thermal expansion which approximates a coefficient of thermal expansion of the monolith, wherein the selecting step includes mixing the moldable material with metal particles so as to produce a mixture having a desired coefficient of thermal expansion.

29. The method of claim 28, further comprising applying the moldable material simultaneously at the ends of the monolith.

30. The method of claim 28, wherein the step of applying the moldable material is performed by a technique selected from the group consisting of thermoplastic injection molding, pressure die casting of metal, and application of a moldable sealant.

* * * * *